US005392609A

United States Patent [19]

Girault et al.

[11] Patent Number: 5,392,609

[45] Date of Patent: Feb. 28, 1995

[54] PROCESS AND APPARATUS FOR THE PRODUCTION OF IMPURE OXYGEN

[75] Inventors: Jean-Louis Girault, Liege, Belgium; Philippe Mazieres, Montfermeil; Jean-Pierre Tranier, Villejuif, both of France

[73] Assignee: L'Air Liquide, Societe Anonyme Pour L'Etude et L'Exploitation des Procedes Georges Claude, Paris, France

[21] Appl. No.: 990,100

[22] Filed: Dec. 14, 1992

[30] Foreign Application Priority Data

Dec. 18, 1991 [FR] France ..... 91 15705

[51] Int. Cl.[6] ..... F25J 3/02

[52] U.S. Cl. ..... 62/25; 62/41

[58] Field of Search ..... 62/24, 25, 41

[56] References Cited

U.S. PATENT DOCUMENTS

| | | | |
|---|---|---|---|
| 3,210,951 | 10/1965 | Gaumer, Jr. | 62/29 |
| 4,372,765 | 2/1983 | Tamura et al. | 62/29 |
| 4,448,595 | 5/1984 | Cheung | 62/31 |
| 4,453,957 | 6/1984 | Pahade et al. | 62/25 |
| 4,704,147 | 11/1987 | Kleinberg | 62/24 |
| 4,853,015 | 8/1989 | Yoshino | 62/24 |
| 4,936,099 | 6/1990 | Woodward et al. | 62/24 |
| 5,006,137 | 4/1991 | Agrawal et al. | 62/24 |
| 5,036,672 | 8/1991 | Rottmann | 62/24 |
| 5,069,699 | 12/1991 | Agrawal | 62/24 |

*Primary Examiner*—Ronald C. Capossela

*Attorney, Agent, or Firm*—Young & Thompson

[57] ABSTRACT

According to this process: the medium pressure column is operated under a pressure which is higher than six bars and is preferably at least equal to about 9 bars absolute; a first vaporization gas which is less volatile than the nitrogen from the top of the medium pressure column is condensed in the vat condenser of the low pressure column; and nitrogen from the top of the medium pressure column is condensed, it is thereafter sent under reflux to the top of the medium pressure column, at a level of the low pressure column located above said vat condenser application to apparatuses for air distillation with double column associated with a gas turbine.

25 Claims, 4 Drawing Sheets

PROCESS AND APPARATUS FOR THE PRODUCTION OF IMPURE OXYGEN

BACKGROUND OF INVENTION (*a*) Field of the invention

The present invention relates to a process for the production of impure oxygen by air distillation in an apparatus for air distillation with a double column, the double column comprising a medium pressure column and a low pressure column.

The applications concerned by the invention are those which consume large quantities of impure oxygen. Processes for gasifying coal or petroleum residues, as well as processes for direct reduction-melting of iron ore may be mentioned.

(*b*) Description of Prior Art

In order to produce impure oxygen by air distillation, i.e. oxygen having a purity lower than 99.5% and generally lower than 98%, it is known that it is possible to decrease the energy expenditure by increasing the operating pressure of the double column, as long as the available energy can be used in the low pressure column in the form of pressure.

A known means to make use of this pressure, which is described for example in U.S. Pat. No. 4,224,045, consists in combining the air distillation apparatus with a gas turbine: the air to be separated is completely or partially withdrawn from the discharge of the compressor of this turbine, and the low pressure residual gas from the distillation apparatus is sent back to the gas turbine after compression, the impure oxygen and the nitrogen being sent to be used under the pressure of the column which produces them.

In this manner, the use of low pressure is completely justified and the energy used for separation is reduced.

The invention aims at still reducing the expenditure of energy which is required for the production of impure oxygen.

SUMMARY OF INVENTION

For this purpose, it is an object of the invention to provide a process characterized in that:

-the medium pressure column is operated under a pressure which is higher than 6 bars and preferably at least equal to about 9 bars absolute;

-a first vaporization gas which is less volatile than nitrogen at the top of the medium pressure column, is condensed in the vat condenser of the low pressure column; and -nitrogen from the top of the medium pressure column is condensed, said nitrogen is thereafter sent under reflux to the top of the medium pressure column, at a level of the low pressure column which is located above said vat condenser.

According to other characteristics:

-the first vaporization gas is a gas which is withdrawn at an intermediate level of the medium pressure column;

-said first vaporization gas consists of medium pressure air;

-said first vaporization gas consists of substantially pure or impure nitrogen which has been compressed at a pressure higher than that of the medium pressure column;

-a second vaporization gas, which is more volatile than said first vaporization gas but which is less volatile than nitrogen at the top of the medium pressure column, is condensed at an intermediate level between those of said condensations;

-impure oxygen is removed in liquid form from the bottom of the low pressure column, it is brought in liquid form at the desired production pressure, and it is vaporized under this pressure by condensation of a third vaporization gas;

-the third vaporization gas consists of substantially pure or impure nitrogen which is produced in the double column and which is compressed at a vaporization pressure of impure oxygen under the production pressure;

-the third vaporization gas consists of air which feeds the double column, and which is compressed at a pressure of vaporization of the impure oxygen under the production pressure.

It is also an object of the invention to provide an apparatus for air distillation with double column and which is adapted for working out such process. According to the invention, this apparatus comprises means for feeding the medium pressure column with air to be distilled under at least about 9 bars absolute, and the low pressure column comprises at least two superposed vaporizers-condensers including one vat vaporizer-condenser, means for feeding this vat vaporizer-condenser with a first vaporization gas which is less volatile than nitrogen from the top of the medium pressure column, means for feeding the second vaporizer-condenser with nitrogen from the top of the medium pressure column, and means for returning the thus condensed nitrogen under reflux at the top of the medium pressure column.

According to other characteristics:

-at least two vaporizers-condensers of the low pressure column are immediately superposed over one another, without intermediate distillation means;

-the apparatus comprises means for withdrawing impure oxygen in liquid form from the vat of the low pressure column, means for compressing this impure liquid oxygen at production pressure, as well as a rectification support nitrogen cycle comprising means for compressing, liquefying, expanding and introducing in the medium pressure column a fraction of the substantially pure or impure nitrogen produced in the double column;

-said compression means are adapted to compress said nitrogen fraction at a vaporization pressure of impure oxygen under said production pressure.

BRIEF DESCRIPTION OF DRAWINGS

Embodiments of the invention will now be described with reference to the annexed drawings, in which.

DESCRIPTION OF PREFERRED EMBODIMENTS

Figure 1:
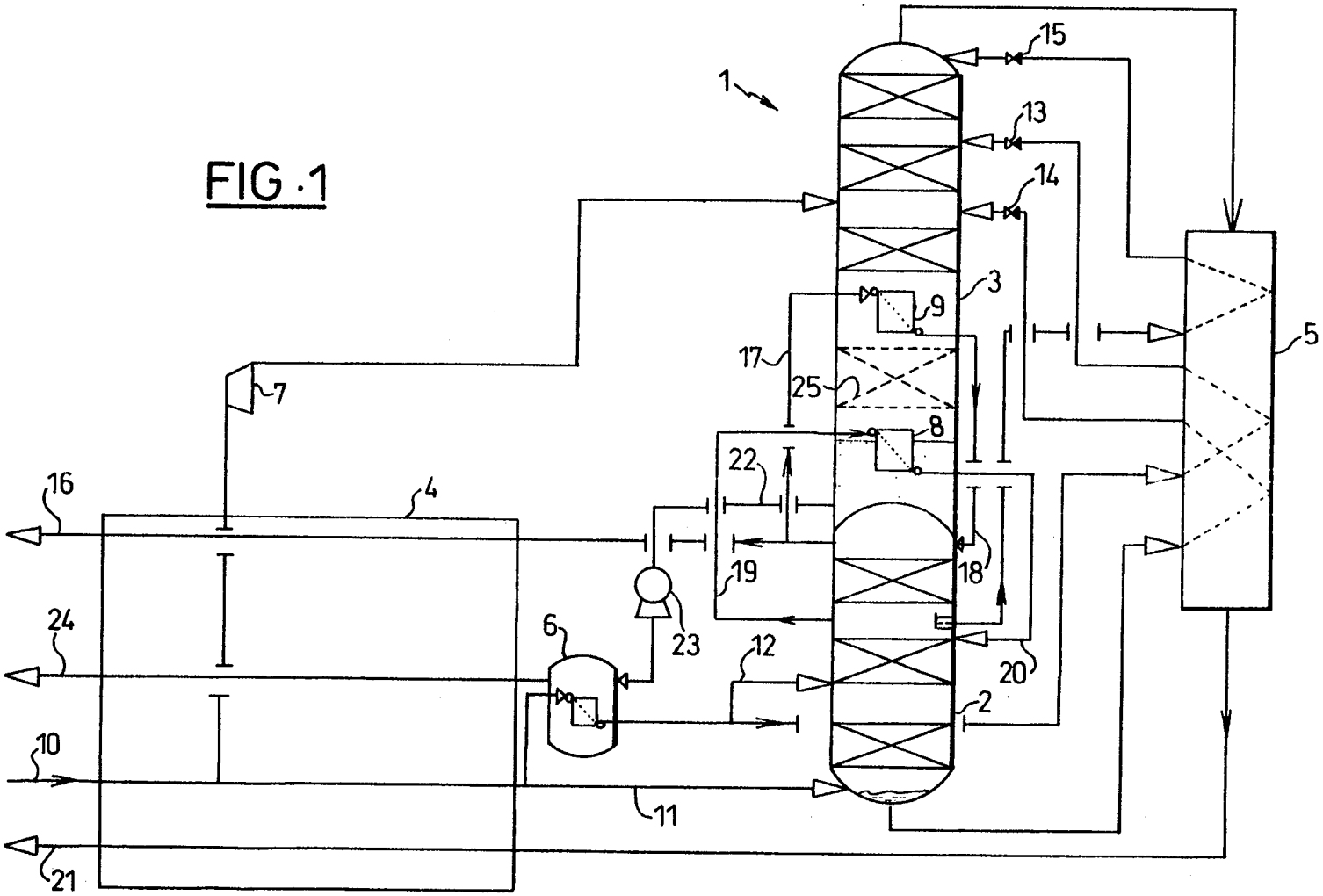
FIGS. 1 to 4 are schematic illustrations of four embodiments of the apparatus for air distillation according to the invention.

The apparatus illustrated in FIG. 1 is intended to produce oxygen at a purity of the order of 85% under a pressure of the order of 7.4 bars absolute. It essentially comprises a double column 1 for air distillation, consisting of a medium pressure column (or "column MP") 2 operating under 15.7 bars absolute and a low pressure column (or "column LP") 3 operating under 6.3 bars absolute, a main heat exchange line 4, a sub-cooler 5, an auxiliary vaporizer-condenser 6 and a turbine 7 for blowing air into the low pressure column. Column 3 is disposed over column 2 and contains, at the bottom, a vaporizer-condenser 8 and, above the latter, a second vaporizer-condenser 9.

The air to be distilled arrives under the medium pressure via a duct 10 and is introduced into heat exchange line 4. The major portion of this air is cooled to the vicinity of its dew point and exits at the cold end of the exchange line, the remainder exiting from the exchange line at an intermediate temperature, being expanded at the low pressure in turbine 7 to ensure cold conditions in the apparatus, and is blown at an intermediate level into column LP 3.

A portion of the entirely cooled air is introduced, via duct 11, at the base of column MP 2, and the remainder is condensed in vaporizer-condenser 6; a portion of the liquid obtained is introduced via duct 12 at an intermediate point of column 2, and the remainder, after subcooling at 5 and expansion in an expansion valve 13, is introduced at an intermediate point of column LP 3.

The "rich liquid" (oxygen enriched air) collected at the bottom of column MP , after subcooling at 5 and expansion in an expansion valve 14, is introduced at an intermediate point of column LP. Similarly, "poor liquid" (impure nitrogen) withdrawn from an intermediate point of column MP, is introduced at the top of column LP after sub-cooling at 5 and expansion in an expansion valve 15.

Substantially pure nitrogen which is withdrawn from the top of column MP is in part removed from the apparatus as a product, after heating in the exchange line, via duct 16, and, the remainder, is sent in gas form via duct 17, under the medium pressure, to the upper vaporizer-condenser 9. After condensation, this nitrogen is introduced as reflux at the top of the column MP via duct 18.

Moreover, impure gaseous nitrogen, withdrawn from an intermediate point of column 2 and, in this example, at the same level as the poor liquid, is sent via duct 19, under the medium pressure, to the lower vaporizer-condenser 8. The liquid thus obtained is introduced as reflux into column MP, substantially at the same level, via duct 20.

The flows of fluids which exit from the double column are:

-at the top of column MP, medium pressure nitrogen, which has been mentioned above;

-at the top of column LP, impure nitrogen, constituting the residual gas of the apparatus. This impure nitrogen, after warming up in the sub-cooler 5 and in exchange line 4, is evacuated via duct 21; and -at the bottom of column LP, impure liquid oxygen. This liquid is withdrawn via duct 22, is compressed by means of pump 23 at the production pressure (7.4 bars absolute in this example), is thereafter vaporized in vaporizer-condenser 6 by condensing the portion of medium pressure air which passes through the latter, then is warmed up in gaseous form in the exchange line and is evacuated from the apparatus via production duct 24.

As a variant, pump 23 could be removed, the impure oxygen then being vaporized at 6 under low pressure.

The above description shows that, for a given temperature difference in the vaporizer-condenser 8, the temperature of the liquid at the bottom of column LP is determined by that of the gas which is condensed in this vaporizer-condenser. Since this is an intermediate gas from column MP, which is warmer than nitrogen from the top of this column, the temperature of the bottom liquid, which consists of impure oxygen, is relatively elevated. Consequently, for a desired purity of this impure oxygen, the pressure of column LP, i.e. the low pressure, may be increased. Finally, there is obtained impure oxygen and impure nitrogen under an increased pressure, which enables to save costs in their production, for example with respect to the energy required to compress impure nitrogen at the desired pressure in a gas turbine (not illustrated) coupled to the apparatus, for example in the manner described in U.S. Pat. No. 4,224,045 mentioned above.

In this context, the upper vaporizer-condenser 9 serves to provide the required reflux at the top of column MP.

If the temperatures of the two gases which are fed to the two vaporizers-condensers are clearly different from one another, it is necessary to provide a certain number of distillation plates 25 between the vaporizers-condensers. In the opposite case, these plates may be removed, which simplifies the construction of column LP, and the two vaporizers-condensers may even be integrated into a single heat exchanger. This is why plates 25 have been illustrated in broken line.

Figure 2:
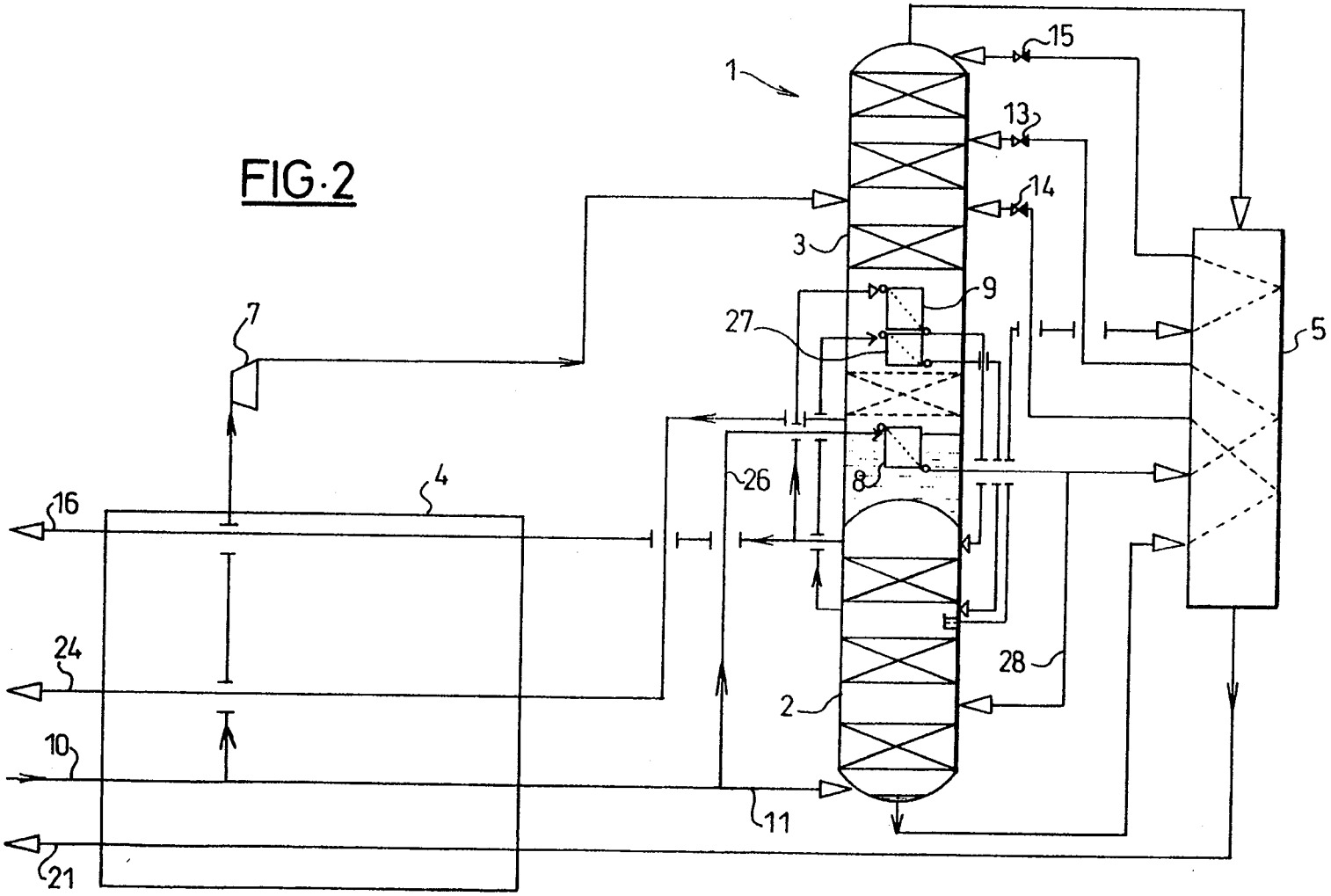

The apparatus illustrated in FIG. 2 differs from FIG. 1 only on the following points.

Impure oxygen is withdrawn as a gas from column LP 3, and is simply warmed up in exchange line 4 before being evacuated via duct 24. This is particularly interesting when impure oxygen is intended to be produced under low pressure. Consequently, the vaporizer-condenser 6 is omitted.

Moreover, a fraction of the medium pressure air which is cooled to the vicinity of its dew point is sent, via duct 26, to lower vaporizer-condenser 8 in place of the intermediate gas of FIG. 1. With respect to this intermediate gas, it feeds an intermediate vaporizer-condenser 27 located between lower and upper vaporizers-condensers 8 and 9. As previously, plates may or may not be provided between the pairs of vaporizers-condensers. Liquefied air which is produced by the vaporizer-condenser 8 is sent in part, via duct 28, into column MP and in part, after sub-cooling at 5 and expansion in expansion valve 13, into column LP.

As compared to the solution of FIG. 1, there is obtained a higher temperature at the bottom of column LP, which is favorable to an increase of the low pressure. On the contrary, a liquid which contains more oxygen than the impure oxygen to be produced must be vaporized, which tends to reduce the low pressure.

Figure 3:
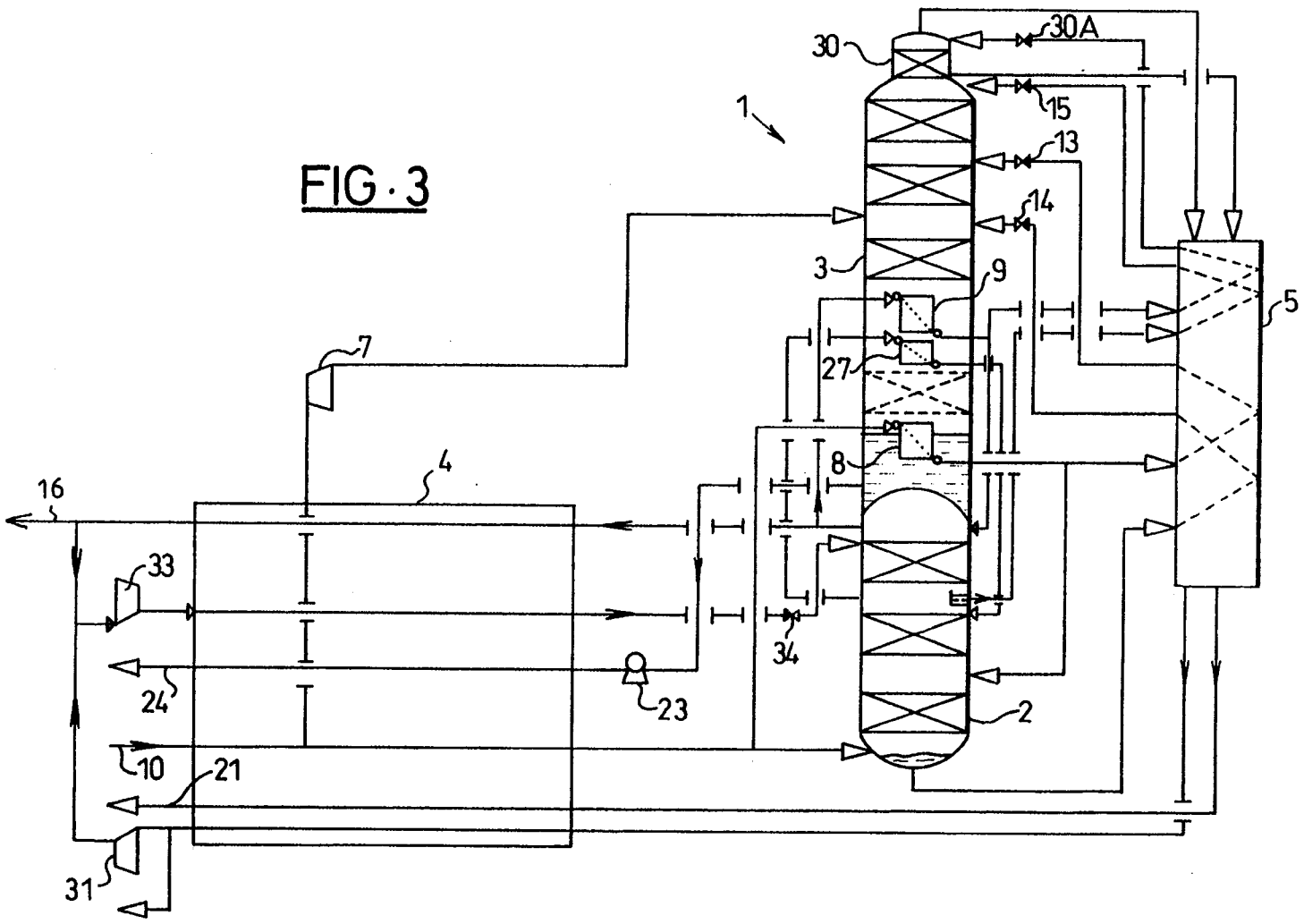

The latter disadvantage is overcome in the apparatus of FIG. 3, which enables to produce impure oxygen under an elevated pressure, and which differs from the previous one on the following points.

On the one hand, impure oxygen is withdrawn in liquid form from the vat of column LP, then is brought by pump 23 to the desired production pressure, is thereafter vaporized and warmed up under this pressure in exchange line 4 before being removed from the apparatus via duct 24.

On the other hand, to compensate for the loss of reflux in column MP resulting from the removal of liquid oxygen at the bottom of column LP, there is provided a nitrogen cycle, so called is rectification support cycle, which used impure simultaneously to ensure the vaporization of oxygen: part of the nitrogen produced at the top of column 3 (which, in this case, has a top "minaret" 30 which is supplied at its top portion by means of pure liquid nitrogen originating from the upper vaporizer-condenser 9 and which, then, produces pure nitrogen under low pressure) is, after warming up in the exchange line, compressed by means of a compressor 31, to the medium pressure. This medium pressure nitrogen, combined with a flow of mean pressure nitrogen withdrawn from duct 16, is again compressed by means of compressor 33 to the vaporization pressure of impure oxygen compressed by means of pump 23, liquefied in the exchange line, and, after expansion in an expansion valve 34, is introduced as reflux at the top of column MP.

Figure 4:
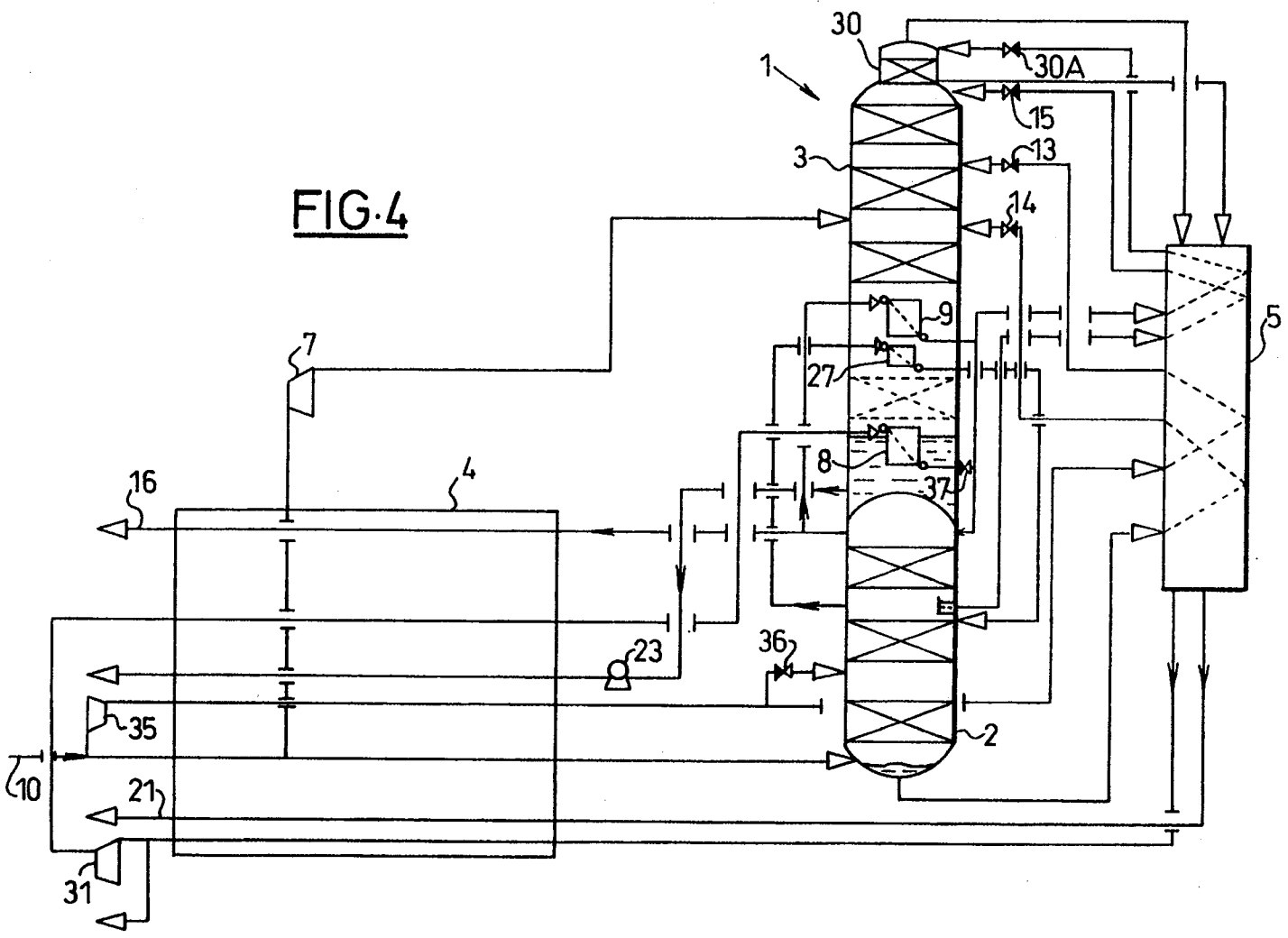

The apparatus of FIG. 4 also includes a column LP 3 with minaret 30. However, contrary to the preceding case, it is high pressure air, boosted to the vaporization pressure of impure oxygen by means of a booster 35, which ensures the vaporization of impure oxygen in the exchange line 4. In this example, after liquefaction and expansion in an expansion valve 36 and fin an expansion valve 13, this air is distributed between the two columns 2 and 3. Consequently, the compressor 33 and the expansion valve 34 of FIG. 3 are omitted.

Moreover, the nitrogen from compressor 31, which is compressed to higher pressure than medium pressure, feeds in gas form, after cooling in the exchange line, the lower vaporizer-condenser 8, and the resulting liquid nitrogen, after expansion in an expansion valve 37, is combined with medium pressure liquid nitrogen which is produced by the upper vaporizer-condenser 9. This has the advantage of permitting a control of the vat temperature of the LP column and therefore the pressure of this column by control of the pressure of nitrogen which feeds the vaporizer-condenser 8. This pressure of nitrogen may be chosen between the medium pressure and the pressure at which nitrogen is condensed at the cold end of the exchange line.

We claim:

1. Process for the production of impure oxygen by air distillation in a double column comprising a medium pressure column and a low pressure column comprising

- operating the medium pressure column under a pressure higher than 6 bars;
- condensing a first vaporization gas which is less volatile than the nitrogen at the top of the medium pressure column, in the bottom condenser of the low pressure column;
- condensing nitrogen from the top of the medium pressure column, at a level of the low pressure column located above said bottom condenser; and
- introducing the thus-condensed nitrogen as reflux at the top of the medium pressure column;

wherein a second vaporization gas, which is more volatile than said first vaporization gas but is less volatile than the nitrogen at the top of the medium pressure column, is condensed at a level which is intermediate between those of said condensations.

2. Process according to claim 1, wherein said first vaporization gas is a gas withdrawn from an intermediate level of the medium pressure column.

3. Process according to claim 1, wherein said first vaporization gas consists of medium pressure air.

4. Process according to claim 1, wherein said first vaporization gas is nitrogen which has been compressed at a pressure higher than that of the medium pressure column.

5. Process according to claim 1, wherein impure oxygen is removed in liquid form from the bottom of the low pressure column, is pumped to the desired production pressure, and is vaporized under this latter pressure by condensation of a third vaporization gas.

6. Process according to claim 5, wherein the third vaporization gas is nitrogen produced by the double column and compressed to the vaporization pressure of impure nitrogen under the production pressure.

7. Process according to claim 5, wherein the third vaporization gas is air feeding the double column, which has been compressed to the vaporization pressure of impure oxygen under the production pressure.

8. Apparatus for air distillation comprising double column comprising a medium pressure column and a low pressure column, means to provide to the medium pressure column air to be distilled under a medium pressure of at least about 9 bars absolute, the low pressure column comprising at least two superposed vaporizers-condensers, including a bottom vaporizer-condenser, means for supplying said bottom vaporizer-condenser with a first vaporization gas which is less volatile than the nitrogen at the top of the medium pressure column, means for supplying the second vaporizer-condenser with nitrogen from the top of medium pressure column to produce condensed nitrogen, and means to introduce the thus-condensed nitrogen as reflux into the top of the medium pressure column; wherein the low pressure column comprises two vaporizers-condensers above the bottom vaporizer-condenser, including a vaporizer-condenser supplied with said top nitrogen and an intermediate vaporizer-condenser supplied with a gas which is less volatile than said top nitrogen and more volatile than said first vaporization gas.

9. Apparatus according to claim 8, wherein at least two vaporizers-condensers of the low pressure column are immediately superposed over one another, without intermediate distillation means.

10. Apparatus according to claim 8, which further comprises means for withdrawing impure oxygen in liquid form from the bottom of the low pressure column, means for raising said impure liquid oxygen in pressure to a production pressure, as well as a rectification support nitrogen cycle comprising means to compress, liquefy, expand and introduce into the medium pressure column a portion of the nitrogen produced by the double column.

11. Apparatus according to claim 10, wherein said compression means are adapted to compress said portion of nitrogen to the vaporization pressure of impure oxygen under said production pressure.

12. Apparatus according to claim 8, which further comprises an air pressure booster adapted to bring a fraction of the air to be distilled at the vaporization pressure of impure oxygen to said production pressure.

13. Process for the production of impure oxygen by air distillation in a double column comprising a medium pressure column and a low pressure column comprising

- operating the medium pressure column under a pressure higher than 6 bars;
- condensing a first vaporization gas withdrawn from said column which is less volatile than the nitrogen at the top of the medium pressure column, in the bottom condenser of the low pressure column;
- condensing nitrogen from the top of the medium pressure column, at a level of the low pressure column located above said bottom condenser; and
- introducing the thus-condensed nitrogen as reflux at the top of the medium pressure column.

14. Process according to claim 13, wherein said first vaporization gas is a gas withdrawn from an intermediate level of the medium pressure column.

15. Process according to claim 13, wherein said first vaporization gas is nitrogen which has been compressed at a pressure higher than that of the medium pressure column.

16. Process according to claim 13, wherein a second vaporization gas, which is more volatile than said first vaporization gas but is less volatile than the nitrogen at the top of the medium pressure column, is condensed at a level which is intermediate between those of said condensations.

17. Process according to claim 13, wherein impure oxygen is removed in liquid form from the bottom of the low pressure column, is pumped to the desired production pressure, and is vaporized under this latter pressure by condensation of a third vaporization gas.

18. Process according to claim 17, wherein the third vaporization gas is nitrogen produced by the double column and compressed to the vaporization pressure of impure nitrogen under the production pressure.

19. Process according to claim 17, wherein the third vaporization gas is air feeding the double column, which has been compressed to the vaporization pressure of impure oxygen under the production pressure.

20. Apparatus for air distillation comprising double column comprising a medium pressure column and a low pressure column, means to provide to the medium pressure column air to be distilled under a medium pressure of at least about 9 bars absolute, the low pressure column comprising at least two superposed vaporizers-condensers, including a bottom vaporizer-condenser, means for withdrawing from said column and for supplying said bottom vaporizer-condenser with a first vaporization gas which is less volatile than the nitrogen at the top of the medium pressure column, means for supplying the second vaporizer-condenser with nitrogen from the top of medium pressure column to produce condensed nitrogen, and means to introduce the thus-condensed nitrogen as reflux into the top of the medium pressure column.

21. Apparatus according to claim 20, wherein the low pressure column comprises two vaporizers-condensers above the bottom vaporizer-condenser, including a vaporizer-condenser supplied with said top nitrogen and an intermediate vaporizer-condenser supplied with a gas which is less volatile than said top nitrogen and more volatile than said first vaporization gas.

22. Apparatus according to claim 20, wherein at least two vaporizers-condensers of the low pressure column are immediately superposed over one another, without intermediate distillation means.

23. Apparatus according to claim 20, which further comprises means for withdrawing impure oxygen in liquid form from the bottom of the low pressure column, means for raising said impure liquid oxygen in pressure to a production pressure, as well as a rectification support nitrogen cycle comprising means to compress, liquefy, expand and introduce into the medium pressure column a portion of the nitrogen produced by the double column.

24. Apparatus according to claim 23, wherein said compression means are adapted to compress said portion of nitrogen to the vaporization pressure of impure oxygen under said production pressure.

25. Apparatus according to claim 20, which further comprises an air pressure booster adapted to bring a fraction of the air to be distilled at the vaporization pressure of impure oxygen to said production pressure.

* * * * *